United States Patent [19]

Shaull

[11] Patent Number: 4,854,015

[45] Date of Patent: Aug. 8, 1989

[54] ADJUSTABLE LOOP CLAMP

[75] Inventor: Lawrence M. Shaull, Renton, Wash.

[73] Assignee: The Boeing Company, Seattle, Wash.

[21] Appl. No.: 205,192

[22] Filed: Jun. 10, 1988

[51] Int. Cl.[4] ..... B65D 63/00

[52] U.S. Cl. ..... 24/16 R; 24/17 A; 24/306; 248/74.3

[58] Field of Search ..... 24/16 R, 16 PB, 17 R, 24/17 A, 17 B, 17 AP, 305 R, 306, 302, 465, 466, 483, 484, 271, 286, 21, 23 B, 23 EE; 248/74.3, 62; 128/DIG. 15

[56] References Cited

U.S. PATENT DOCUMENTS

| | | | |
|---|---|---|---|
| 2,373,833 | 4/1945 | Johnson | 248/74.3 |
| 2,434,720 | 1/1948 | Robertson et al. | 298/74.3 |
| 2,491,290 | 12/1949 | Tinnerman | 24/16 R |
| 2,915,268 | 12/1959 | Wrobel | 248/74 |
| 2,936,980 | 5/1960 | Rapata | 248/74.3 |
| 3,000,384 | 9/1961 | Piers, Jr. | 128/DIG. 15 X |
| 3,302,913 | 2/1967 | Collyer et al. | 248/73 |
| 3,313,511 | 4/1967 | Koerner et al. | 248/361 |
| 3,471,109 | 10/1969 | Meyer | 248/68 |
| 3,913,876 | 10/1975 | McSherry | 248/74 |
| 3,994,048 | 11/1976 | Rosenthal | 24/81 |
| 4,073,317 | 2/1978 | Ellis | 24/271 X |
| 4,088,136 | 5/1978 | Hasslinger et al. | 128/349 |
| 4,094,021 | 6/1978 | Rapp | 4/172.12 |
| 4,096,863 | 6/1978 | Kaplan et al. | 128/349 |
| 4,149,540 | 4/1979 | Hasslinger | 128/DIG 15 X |
| 4,235,404 | 11/1980 | Kraus | 248/74 |
| 4,353,519 | 10/1982 | Bogart | 248/72 |
| 4,358,081 | 11/1982 | Notoya | 248/73 |
| 4,389,754 | 6/1983 | Sohma | 24/16 PB |
| 4,447,934 | 5/1984 | Anscher | 248/74.3 X |
| 4,616,436 | 10/1986 | De Woskin | 24/16 PB X |
| 4,735,387 | 4/1988 | Hirano et al. | 248/71 |
| 4,759,963 | 7/1988 | Uso, Jr. et al. | 428/100 |

*Primary Examiner*—Kenneth J. Dorner
*Assistant Examiner*—Laurie K. Cranmer
*Attorney, Agent, or Firm*—Glenn D. Bellamy; Delbert J. Barnard

[57] ABSTRACT

A loop clamp is provided for binding a wire bundle together or for attaching such a wire bundle to a support member. The loop clamp includes a base and a flexible strap having first and second surfaces on opposite sides. One surface includes a plurality of upstanding hook elements and the other surface a plurality of upstanding loop elements, each extending over a substantial area of the strap. One end of the strap is attached to the base and the other end may be passed through an opening formed in the base, thereby providing a size-adjustable loop. Respective upstanding hook and loop elements of the guided length of strrap and an outer portion of the loop may be engaged, thereby fixing the size of the loop and binding wires or the like therein.

16 Claims, 3 Drawing Sheets

Fig. 10
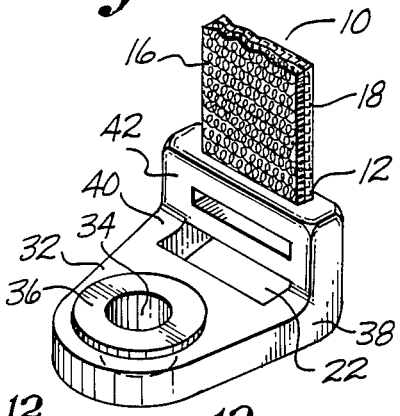
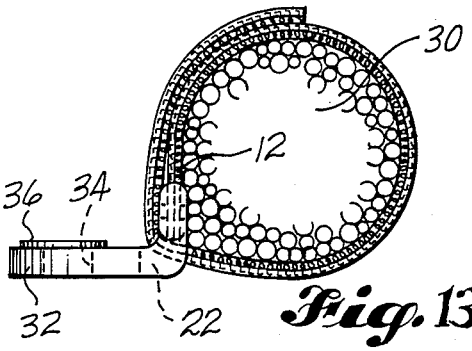
Fig. 13
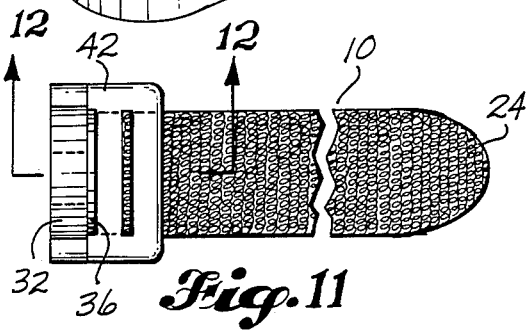
Fig. 11
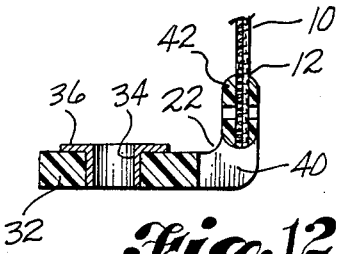
Fig. 12
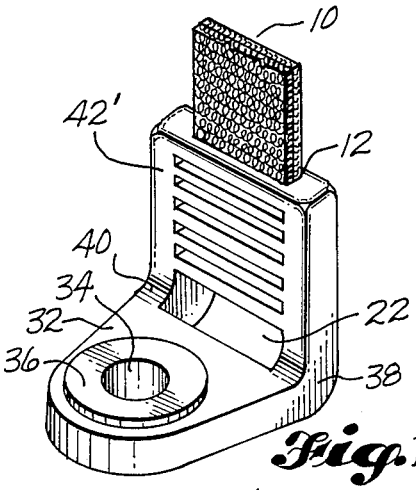
Fig. 14
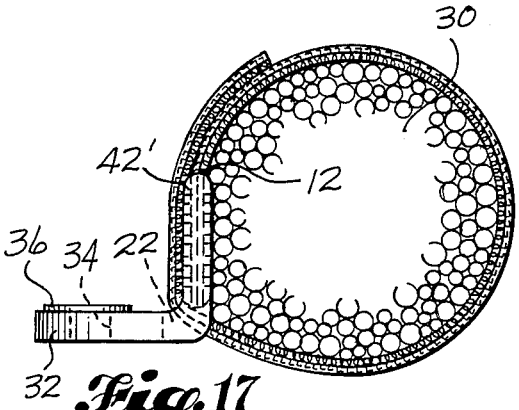
Fig. 17
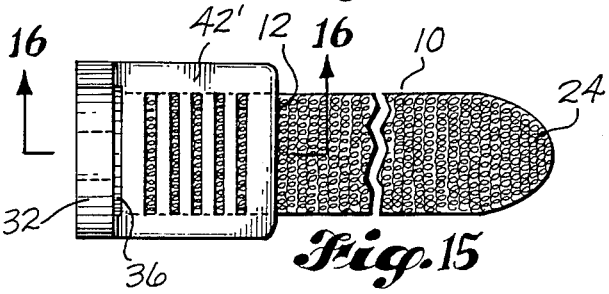
Fig. 15
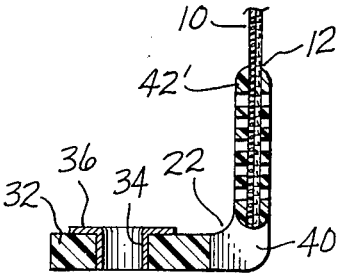
Fig. 16

ADJUSTABLE LOOP CLAMP

DESCRIPTION

TECHNICAL FIELD

This invention relates to a separable loop clamp device for binding a plurality of wires or similar articles together or for attaching a plurality of wires or similar article to a fixed support.

BACKGROUND ART

It is well-known in the art to use a tie device or a "P-clamp" for binding together or mounting a plurality of wires. A prior art "P-clamp" is made of resilient metal or plastic material and comprises a pair of adjacent arm portions connected by an enlarged bight portion. A fastener may be passed through the arms to close the clamp or to attach it to a support structure. Such prior art clamps have little or no size adjustability and require replacement when there is a significant change in size of the wire bundle to be bound. Prior art tie devices having a variable capacity and using a ratchet closing mechanism are often subject to damage or destruction when capacity is later re-adjusted.

DISCLOSURE OF THE INVENTION

The present invention provides an adjustable loop clamp which includes a flexible strap having a plurality of mating engaging elements upstanding from respective opposite surfaces thereof. One end of the strap is attached to a base member and the other end may be passed through an opening formed in the base member so that the strap forms an article binding loop, the size of which varies depending on the length of the strap which is passed through the opening and the size of the article to be bound. One surface of the strap will form the inner side of the loop and the other surface will form the outer side of the loop. The inner surface of the strap which has been passed through the opening may be brought into engaging contact with the outer surface of the strap which forms the loop, thereby fixing the side of the loop and binding the article therein.

The engaging elements may be constructed in the form of hook-type hooking elements which mate with loop-type hooking elements. Preferably, the strap is constructed of VELCRO® brand separable fastener tape materials attached to opposite surfaces of a single fabric backing or on separate components secured back-to-back. However, it should be understood that any flexible engaging elements which are readily securable in face-to-face relation, and which particularly resist forces parallel to the interfacial plane of engagement, but which are readily separable by a peeling action, are contemplated within the scope of the present invention.

A flange member, having an attachment hole therein, may be part of the base member so that the entire loop clamp may be secured to a support member. The mounting opening may also include a reinforcement grommet. The base and the flange may be oriented either in parallel but offset planes or in perpendicular planes with respect to each other.

In preferred form, the base, which is made of a thermoplastic material, and the strap, which is woven or knitted of a synthetic heat-deformable material such as nylon, polyester, or the like, are attached by being integrally molded together. The strap may also be attached to the base by passing one end of the strap through a second opening formed in the base, folding the strap back, and attaching the strap to itself by sewing, gluing, heat welding, or the like.

According to an aspect of the invention, one set of the engaging elements is provided on the base member, generally adjacent the transverse opening. The size of the loop is fixed by bringing the engaging elements of the strap surface which has been guided through the opening into engaging contact with the mating engaging elements of the base member. In this manner, strain placed on the loop portion of the strap will be transferred to the portion of strap which passes through the transverse opening and engages the base surface. The engagement is resistant to longitudinal displacement, but is easily separated by peeling the strap away from the base surface. A flange portion may be provided for attachment of the base member to a support member.

Thus, a primary object of the invention is to provide plural forms of a durable loop clamp, each of which securely binds wires or cables together and which provides universal sizing and adjustability.

BRIEF DESCRIPTION OF THE DRAWINGS

Referring to the several drawing figures, wherein like numerals refer to like parts throughout, and wherein:

FIG. 10 is a fragmentary pictorial view of an alternative embodiment of the invention;

FIG. 11 is a top plan view of the embodiment shown in FIG. 10;

FIG. 12 is cross-sectional view taken substantially along line 12—12 of FIG. 11;

FIG. 13 is a side view of the embodiment shown in FIG. 10 with bundled wires shown in cross-section;

FIG. 14 is a fragmentary pictorial view of another embodiment of the invention;

FIG. 15 is a top plan view of the embodiment shown in FIG. 14;

FIG. 16 is a cross-sectional view taken substantially along lines 16—16 of FIG. 15;

FIG. 17 is a side view of the embodiment shown in FIG. 14 with bundled wires shown in cross-section;

BEST MODE FOR CARRYING OUT THE INVENTION

Figure 2:
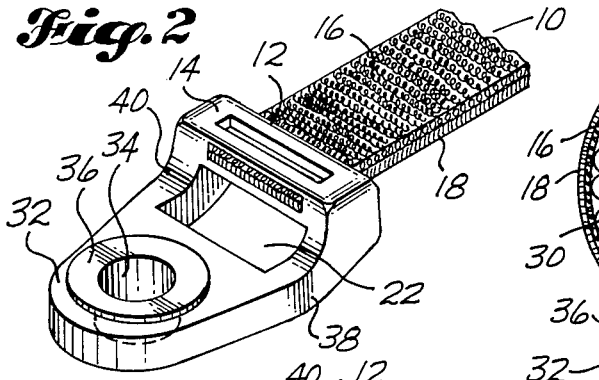
FIG. 2 is a fragmentary pictorial view of a preferred embodiment of the invention.
Figure 1:
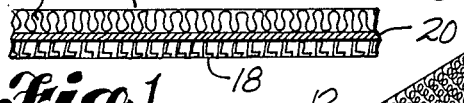
FIG. 1 is a fragmentary cross-sectional view of the two-sided strap material.
Figure 6:
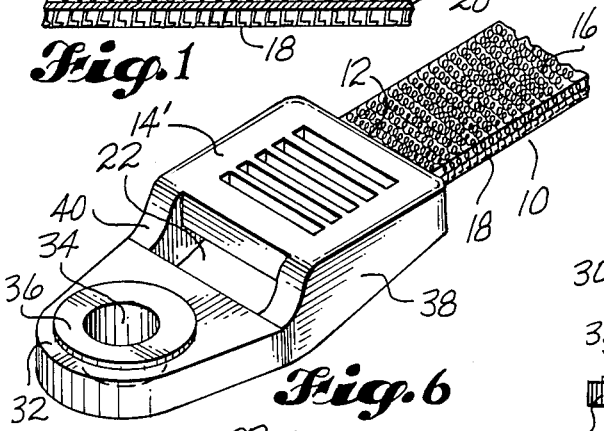
FIG. 6 is a framentary pictorial view of another preferred embodiment of the invention.
Figure 9:
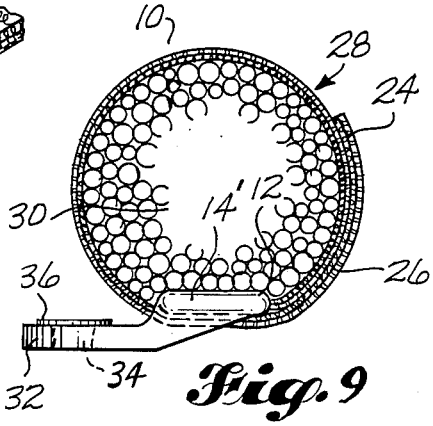
FIG. 9 is a side view of the embodiment shown in FIG. 6 with bundled wires shown in cross-section.
Figure 7:
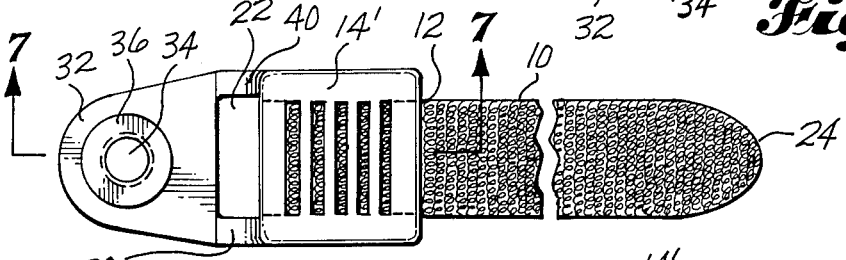
FIG. 7 is a top plan view of a preferred embodiment of the invention.
Figure 8:
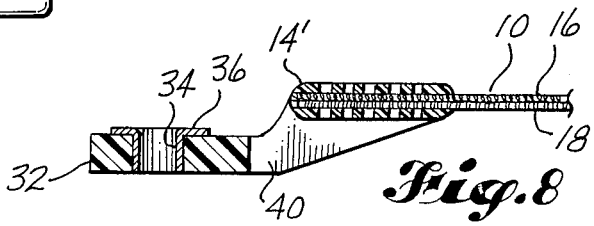
FIG. 8 is a cross-sectional view taken substantially along line 7—7 of FIG. 3.
Figure 18:
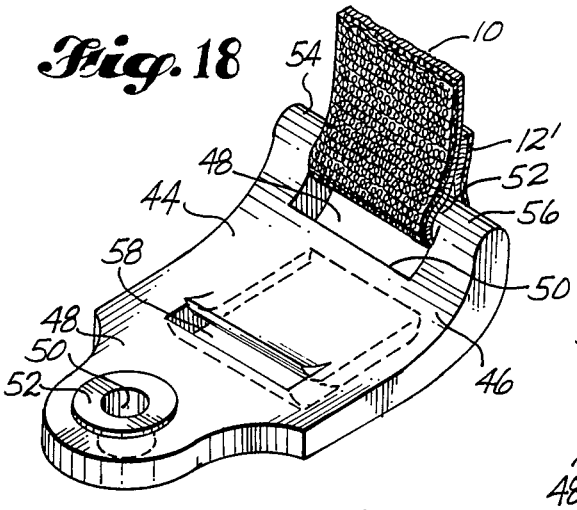
FIG. 18 is a fragmentary pictorial view of still another embodiment of the invention.
Figure 21:
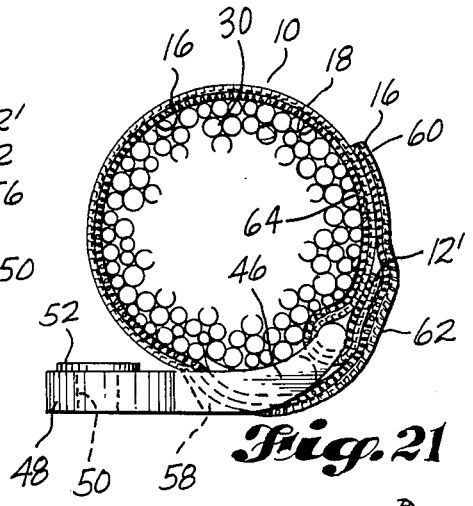
FIG. 21 is a side view of the embodiment shown in FIG. 18 with bundled wires shown in cross-section.
Figure 19:
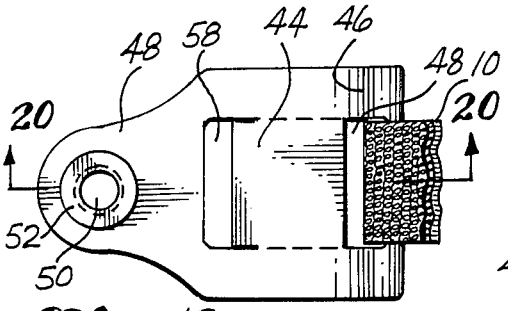
FIG. 19 is a top plan view of the embodiment shown in FIG. 18.
Figure 20:
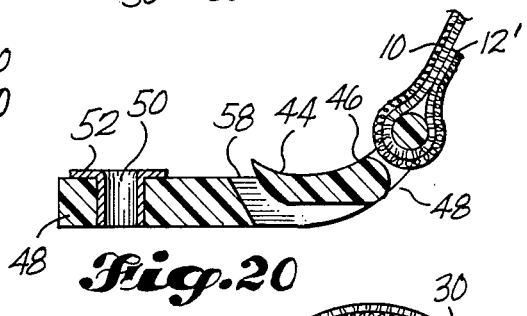
FIG. 20 is a cross-sectional view taken substantially along line 20—20 of FIG. 19.
Figure 22:
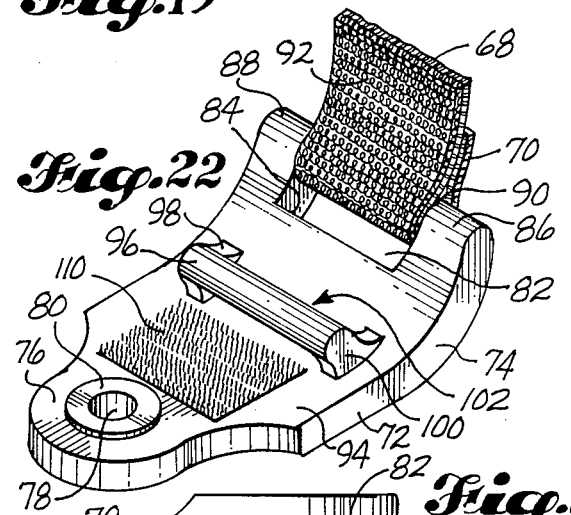
FIG. 22 is a fragmentary pictorial view of yet another embodiment of the invention.
Figure 25:
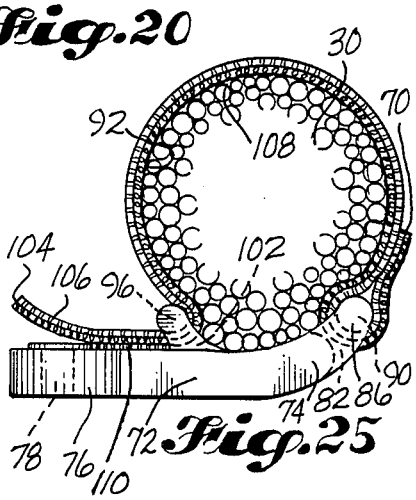
FIG. 25 is side view of the embodiment shown in FIG. 22 with bundled wires shown in cross-section.
Figure 23:
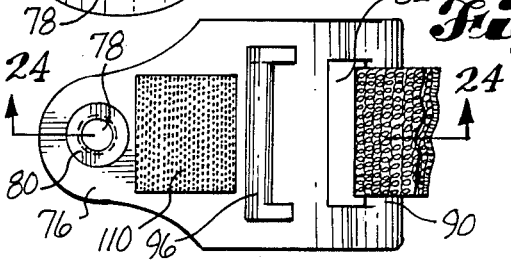
FIG. 23 is a top plan view of the embodiment shown in FIG. 22.
Figure 24:
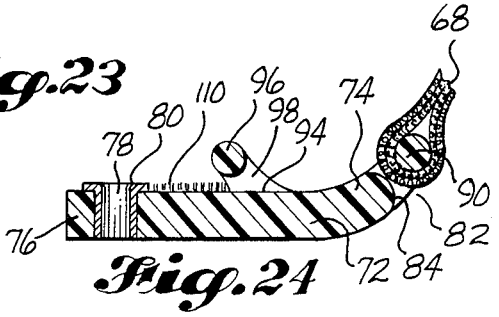
FIG. 24 is a cross-sectional view taken substantially along line 24—24 of FIG. 23.

Referring now to the several figures of the drawing, and first to FIG. 1, therein is shown in sectional view a portion of the strap 10 of a preferred embodiment of the invention. The strap 10 is in the form of an elongated flexible fabric tape which is connected at a first end 12 to a base member 14, as shown in FIG. 2. The strap 10 has two opposing surfaces 16, 18 each having respective engaging elements upstanding therefrom. One surface 16 consists of a multiplicity of small loops made of filamentary material, the material being stiff enough so that the loops project outwardly from the face of the strap 10. The other surface 18 consists of a multiplicity of small filamentary hook members of curled or crimped configuration. The two types of surfaces 16, 18 display the property that when they are brought into juxtaposition, a number of the individual filamentary hook members become intertwined with the outwardly projecting loop members and thereby retain the parts in a coupled of fastened relation. It is of no consequence which side bears hook or loop elements, so long as respective mating engaging elements are on opposite sides. Preferably, the interengaging surfaces are those incorporated in fastening tapes sold commercially under the trademark VELCRO® by Velcro Corp., New York, N.Y. The engaging elements may be woven or knitted onto opposite surfaces of a single base fabric 20, or may be manufactured separately and attached together in a back-to-back relationship.

Figure 3:
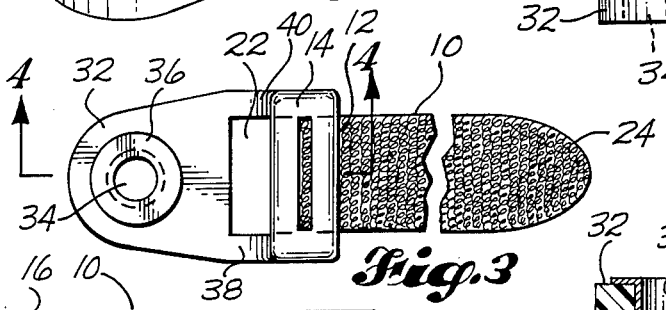
FIG. 3 is a top plan view of the embodiment shown in FIG. 2.
Figure 4:
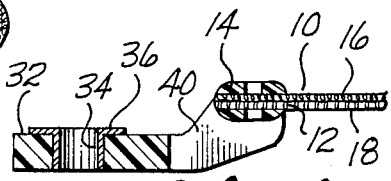
FIG. 4 is a cross-sectional view taken substantially along line 4—4 of FIG. 3.

In preferred form, both the base 14 and the strap 10 are made of a thermoplastic material and are attached to each other by being integrally molded together, as shown in FIGS. 2–4. The first end 12 of the strap 10 may be placed within the mold and then encapsulated by the injection of molten thermoplastic material into the mold which forms the base 14.

Figure 5:
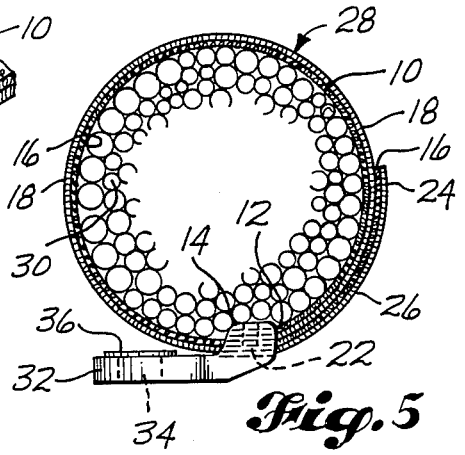
FIG. 5 is a side view of the embodiment shown in FIG. 2 with bundled wires shown in cross-section.

The base 14 includes an opening 22 of sufficient size to allow a second end 24 of the strap 10 to be guided therethrough. As shown in FIG. 5, when a portion 26 of the strap 10 is guided through the opening 22, a loop 28 is formed. The size of the loop 28 depends upon the length of the portion 26 which has been guided through the opening 22. The first surface 16 of the strap 10 forms the interior of the loop 28 and the second surface 18 forms the outer surface of the loop 28. The first surface 16 of the portion 26 which has been guided through the opening 22 may be brought into engaging juxtaposition with the second surface 18 of the portion of strap 10 which forms the loop 28, thereby fixing the size of the loop 28. A plurality of wires or cables 30 may be bound by the loop 28. The engagement of the first and second surfaces 16, 18 of the strap 10, being particularly resistant to displacement by forces parallel to the interfacial plane of engagement, allow the wires or cables 30 to be firmly secured to the base 14. The loop clamp is easily re-adjusted by peeling the portion 26 of the strap 10 away from the outer surface 18 of the loop portion 28, beginning at the second end 24 of the strap 10. Engagement and disengagement of the strap surfaces 16, 18 may be performed repeatedly without damage to the loop clamp or degradation of the engagement.

The maximum diametric capacity of the loop clamp is determined only by the total length of the strap 10. Because the engaging elements extend substantially along the entire length of the strap surfaces 16, 18, the loop clamp can be adjusted to an infinite number of sizes between its maximum capacity and an empty state.

To provide attachment of the loop clamp to a support member, the base 14 may also include a flange portion 32 which extends outwardly therefrom and includes an opening 34 sized to receive a fastener (not shown). The opening 34 may include a reinforcing or cushioning grommet 36.

In one embodiment, the base 14 and the flange portion 32 are oriented in parallel, but offset, planes and connected by spaced-apart sidewall members 38, 40. As shown in FIGS. 2–4, The opening 22 in this embodiment is defined between the base 14, the flange portion 32, and the sidewall members 38, 40. This offset orientation allows the strap 10 to pass unobstructed through the opening 22 under the base 14, and guides the portion 26 of the strap 10 which has been passed through the opening 22 into alignment to be engaged with the loop portion 28 of the strap 10.

The alternative embodiment shown in FIGS. 6–9 is identical in construction and function to that previously described, with the exception that the base member 14′ is extended to allow a larger portion of the first end 12 of the strap 10 to be integrally molded therein. This extended base member 14′ also provides a larger surface against which the bundle of wires 30 is bound.

The embodiment shown in FIGS. 10–13 is identical in function to that previously described, but differs in construction in that base member 42 and flange portion 32 are situated in substantially perpendicular planes. As shown in FIG. 13, this allows the bundle of wires 30 to be bound and held in a position offset from, rather than adjacent to the flange portion 32. By this construction, access to mounting hole 34 will not be hindered by a large bundle of wires or cables 30. Furthermore, such a construction could allow groups of wires or cables 30 to be bound and mounted where space limitations require such offset attachment.

The alternative embodiment shown in FIGS. 14–17 is identical in function and construction to that just described, with the exception that base member 42′ is extended to allow a larger portion of the first end 12 of strap 10 to be integrally molded therein. As in the alternative embodiment previously described, the extended base member 42 also provides a larger surface against which a bundle of wires or cables 30 may be bound.

Shown in FIGS. 18–21 is yet another embodiment of the invention. Base member 44 has an upwardly-curved portion 46 at one end. Opposite the upwardly-curved portion 46 is a flange portion 48. An opening 50 sized to receive a fastener is formed in the flange portion 48. Such a fastener may be inserted through the opening 50 to secure the loop clamp to a support member. The opening 50 may include a reinforcing or cushioning grommet 52.

The strap 10 is attached to the base 44 at the upwardly turned portion 46 by passing the first end 12′ of the strap 10 through an opening 48 and then attaching the end 12′ to the strap 10. The opening 48 may be defined by a notch formed in the upwardly-curved portion 46 and a post member 52 extended between outward edges 54, 56 of the notch 50. The strap 10 envelopes the post member 52 when the first end 12' is folded through the opening 48. The first end 12' may be attached to the strap 10 by sewing, gluing, heat welding, or the like. A second opening 58 is provided in the base 44 and is sized to receive a second end 60 of the strap 10. In the previously-described manner, when a portion 62 of the strap 10 is guided through the opening 58, a loop 64 is formed. The size of the loop 64 depends upon the length of the portion 62 which has been guided through the opening 58. The first surface 16 of the strap 10 forms the interior of the loop 64 and the second surface 18 forms the outer surface of the loop 64. The first surface 16 of the portion 62 which has ben guided through the opening 58 may be brought into engaging juxtaposition with the second surface 18 of the portion of the strap 10 which forms the loop 64. In this manner, the size of the loop 64 is fixed and wires or cables 30 are bound by the loop 64. The loop 64 may be opened or re-adjusted in size simply by separation of the engagement of the first and second surfaces 16, 18 and re-engagement of the same.

FIGS. 22–25 show an alternative construction and means for binding wires or cables 30 in a loop clamp. Provided is a strap 68 which is attached adjacent a first end 70 to a base member 72. The base member 72 includes an upwardly-curved portion 74 at one end and a flange portion 76 at an opposite end. The flange portion 76 may include an opening 78 sized to receive a fastener (not shown) for attaching the base member 72 to a support member. The opening 78 may also include a reinforcing or cushioning grommet 80. The strap member 68 is attached to the base member 72 at the upwardly-curved portion 74. The first end 70 may be passed through an opening 82, folded back, and attached to the strap 68 by sewing, gluing, heat welding, or the like. The opening 82 may be defined by a notch 84 formed between two opposing extensions 86, 88 of the upwardly-curved portion 74 and a post member 90 which extends across the opening of the notch 84 between the extended portion 86, 88.

Upwardly spaced from an upper surface 94 of the base member 72 is a bridge member 96. The bridge member 96 is substantially parallel to the upper surface 94 of the base member 72 and the post member 90. The bridge member 96 is supported at each end by support members 98, 100 which extend between respective ends of the bridge member 96 and the upper surface 94 of the base member 72. A second opening 102 is defined between the upper surface 94, the bridge member 96 and the support members 98, 100. The second opening 102 is sized to receive a second end 104 of the strap 68. When a portion 106 of the strap 68 is guided through the second opening 102, a loop 108 is formed, the size of which depends upon the length of the portion 106 which has been guided through the second opening 102.

In this embodiment, the strap member 68 includes one surface 92 having a multitude of engaging elements upstanding therefrom. An area 110 of the upper surface 94 is provided with a plurality of mating engaging elements upstanding therefrom. The engaging elements of the area 110 are complementary to the engaging elements of the strap surface 92 and, in preferred form, the engaging elements of the strap surface 92 are small loops made of filamentary material woven or knitted onto a base fabric and the engaging elements of the upper surface area 110 are filamentary hook members of a curled or crimped configuration integrally molded therein or otherwise attached thereto. The filamentary hook members may be formed onto a fabric substrate and then attached to the base member 72 by encapsulation of the substrate when molten thermoplastic material is injected into a mold to form the base member 72.

A plurality of wires or cables 30 may be bound within the loop 108 which is fixed in size by bringing the surface 92 of the guided portion 106 of the strap 68 into engaging juxtaposition with the upper surface area 110 of the base member 72. The engagement between the surfaces 92, 110, being particularly resistant to forces parallel to the interfacial plane of engagement, will tightly secure the wires of cables 30 within the loop 108. This engagement, however, is easily released for re-adjustment by peeling apart the respective surfaces 92, 110.

The latter embodiment provides the advantage that its strap member 68 requires only a single surface 92 bearing engaging elements, rather than opposed surfaces having mating engaging elements, as in the strap 10 of the former embodiments.

It is to be appreciated that the described and illustrated embodiments of the invention represent the current best mode for carrying out the invention. Obviously, certain changes could be made to the invention without departing from its overall spirit and scope. Nothing in the above description is meant to be taken in a limiting sense regarding the scope of allowable patent protection due the applicant or his assignees. The scope of such protection is to be defined solely by the following claims, wherein such claims are to be interpreted in accordance with the well-established doctrines of patent claim interpretation.

What is claimed is:

1. A flexible loop clamp, comprising;

a rigid base member including a mounting portion means for connecting to a support structure, to in that manner fix the base member in position on the support structure, a strap attachment portion having opposite ends, a through opening positioned between the mounting portion means and the strap attachment portion, and connector portions extending between and interconnecting the mounting portion means and the opposite ends of the strap attachment portion and outward bounding said opening;

a flexible clamping strap comprising a flexible fabric body having first and second ends, said first end of the strap being attached to said strap attachment portion of the rigid base member, to extend from it in a direction generally opposite the mounting portion;

said opening being sized to receive and pass said flexible strap, so that said flexible strap can be looped around an article and then inserted through said opening, to form said strap into a loop portion which encircles the article and a tail portion which extends outwardly from the opening and which includes said second end;

complementary connector elements extending over a substantial area of an inner surface of the tail portion of the strap and a confronting outer surface of the loop portion of the strap, wherein the connector elements on one of said surfaces are upstanding hook elements and the connector elements on the other surface are upstanding loop elements;

said strap attachment portion including bearing surface means for bearing against said strap contiguous the first end of the strap, along which said strap may slide while the second end of the strap is being pulled through the opening positioned between the mounting portion means and the strap attachment portion to tighten the loop about the article;

said loop portion of the strap defining a closed loop which starts from said strap attachment portion of the base member, then extends away from said base member and the support structure to which it is connected, around the article, then back to said base member, through said opening, and against said bearing surface means; and said bearing surface means located substantially on an outer boundary of said closed loop, so that following a pulling on the second end of the strap to tighten the loop portion of the strap, and while maintaining said tightening pull on said strap, the tail portion of the strap can be swung inwardly toward and against an outer surface of the loop portion of the strap to, in that manner, cause connecting engagement of the connector elements on the tail portion of the strap with the connector elements on the confronting loop portion of the strap.

2. The loop clamp of claim 1, wherein said strap attachment portion is spaced from said base member such that when said base member is connected to said support structure, said strap attachment portion is outwardly spaced from said support structure.

3. The loop clamp of claim 2, wherein said mounting portion means and said strap attachment portion are in parallel but offset planes.

4. The loop clamp of claim 1, wherein said strap extends from said strap attachment portion in a direction generally parallel to said support structure.

5. The loop clamp of claim 1, wherein said strap extends from said strap attachment portion in a direction generally perpendicular to said support structure.

6. The loop clamp of claim 1, wherein said rigid base member is formed of a molded thermoplastic material and said strap is attached to said strap attachment portion by said first end being encapsulated within said thermoplastic material.

7. The loop clamp of claim 1, wherein said mounting portion means includes an opening sized to received a fastener for attaching said rigid base member to said support structure.

8. The loop clamp of claim 7, wherein said opening includes a reinforcing grommet.

9. A flexible loop clamp, comprising:

a rigid base member including an upper surface and a mounting portion which is connectible to a support structure to, in that manner, fix the base member in position on the support structure;

a strap attachment portion on said base member;

a flexible clamping strap comprising a flexible fabric body having first and second ends, said first end being attached to said strap attachment portion to extend from said base member outwardly therefrom;

an engagement area on the upper surface of said base member opposite said strap attachment portion including a plurality of connector elements;

complementary connector elements extending over a substantial area of a surface of the strap, and the connector elements on one of said strap and said base surfaces are upstanding hook elements and the connector elements on the other surface are upstanding loop elements;

said base member including a transverse guideway being sized to receive and pass said strap located between said strap attachment portion and said engagement surface having a first opening generally adjacent said strap attachment portion and a second opening generally adjacent said engagement area, such that said flexible strap can be looped around an article and then inserted through said second opening to form said strap into a loop portion which encircles the article and a tail portion including said second end which extends through said guideway and outwardly from the second opening such that said engagement surface of said strap may be moved into juxtaposition with said engagement area of said base member;

said transverse guideway including a bearing surface for said strap between said openings along which said strap may slide while the second end of the strap is being pulled upon to tighten the loop about the article;

said loop portion of the strap defining a closed loop which starts from said strap attachment portion of the base member, then extends away from said base member and the support structure to which it is connected, around the article, then back to said base member, through said guideway against said bearing surface, and outwardly from said second opening generally toward said base engagement area; and said bearing surface being located substantially between said openings of said guide passage so that following a pulling on the second end of the strap to tighten the loop portion of the strap, and while maintaining said tightening pull on said strap, the tail portion of the strap can be swung toward and against said engagement area of the upper surface of the base member to, in that manner, cause infinitely adjustable connecting engagement of the connector elements on the surface of the strap with the connector elements on the upper surface of the base member and, thereby, fix the size of the loop and clamp said article into a fixed position relative to said support structure.

10. The loop clamp of claim 9, wherein said guideway includes a bearing member spaced above said upper surface and having opposite ends supported by support members which extend between said ends and said upper surface of said base member and said bearing surface being on said bearing member.

11. The loop clamp of claim 9, wherein said base member is made of a molded thermoplastic material and said strap is attached to said strap attachment portion by said first end of said strap being encapsulated in said thermoplastic material.

12. The loop clamp of claim 9, wherein said mounting portion of said rigid base member includes an opening sized to receive a fastener for attaching said rigid base member to said support structure.

13. The loop clamp of claim 9, wherein said opening includes a reinforcing grommet.

14. The loop clamp of claim 9, wherein said mounting portion of said rigid base member is located outwardly of said engagement area on the upper surface of said base member.

15. The loop clamp of claim 14, wherein said mounting portion includes an opening sized to receive a fastener for attaching said rigid base member to said support structure.

16. The loop clamp of claim 15, wherein said opening includes a reinforcing grommet.

* * * * *

UNITED STATES PATENT AND TRADEMARK OFFICE

CERTIFICATE OF CORRECTION

PATENT NO. : 4,854,015

DATED : August 8, 1989

INVENTOR(S) : Lawrence M. Shaull

It is certified that error appears in the above-identified patent and that said Letters Patent is hereby corrected as shown below:

On the title page, item [57]:

In the Abstract, third line from the bottom, "straap" should be -- strap --.

Column 2, line 36, "framentary" should be -- fragmentary --.

Column 2, delete lines 38 and 39.

Column 3, line 32, "of", first occurrence, should be -- or --.

Column 5, line 16, "ben" should be -- been --.

Column 5, line 43, "portion" should be -- portions --.

Column 6, line 15, "of" should be -- or --.

Claim 1, column 6, line 37, "comprising;" should be -- comprising: --; and in column 7, line 14, after "means", insert -- being --.

Claim 7, column 7, line 45, "received" should be -- receive --

Claim 9, column 7, line 52, "connectible" should be -- connectable --.

Signed and Sealed this

Twelfth Day of November, 1991

*Attest:*

*Attesting Officer*

HARRY F. MANBECK, JR.

*Commissioner of Patents and Trademarks*